United States Patent [19]

Gadeix et al.

[11] 4,322,040

[45] Mar. 30, 1982

[54] MANUAL STARTING DEVICE FOR WINDING YARN ONTO A BOBBIN

[75] Inventors: Jean-Marie Gadeix, Mulhouse; Francois Wolf, Illfurth, both of France

[73] Assignee: Societe Alsacienne de Constructions Mecaniques de Mulhouse, Mulhouse, France

[21] Appl. No.: 111,596

[22] Filed: Jan. 14, 1980

[30] Foreign Application Priority Data

Jan. 12, 1979 [FR] France ..... 79 00718
Jul. 10, 1979 [FR] France ..... 79 17816

[51] Int. Cl.[3] ..... B65H 54/02
[52] U.S. Cl. ..... 242/18 PW; 242/18 DD
[58] Field of Search ..... 242/18 PW, 18 DD, 18 A; 57/299, 279

[56] References Cited

U.S. PATENT DOCUMENTS 3,952,959 4/1976 Shaw et al. ..... 242/18 PW
3,974,972 8/1976 Egli et al. ..... 242/18 PW
4,057,196 11/1977 Amos ..... 242/18 PW
4,084,759 4/1978 Piro ..... 242/18 PW
4,105,165 8/1978 Miyazaki et al. ..... 242/18 PW
4,143,825 3/1979 Lovas et al. ..... 242/18 PW
4,154,409 5/1979 Reisser et al. ..... 242/18 PW
4,158,444 6/1979 Krauss ..... 242/18 PW
4,164,330 8/1979 Maassen et al. ..... 242/18 PW

FOREIGN PATENT DOCUMENTS 1435235 5/1976 United Kingdom ..... 242/18 PW

*Primary Examiner*—Stanley N. Gilreath
*Attorney, Agent, or Firm*—Cantor and Singer

[57] ABSTRACT

The yarn-winding system comprises a delivery roller, a press roller, a winding roller, a yarn guide, two winding arms and a winding tube. The manual starting device for winding yarn onto a bobbin and forming a yarn reserve comprises a fixed suction nozzle and a fixed hook located at levels which are respectively lower and higher than the winding roller and displaced to one side with respect to said roller.

11 Claims, 7 Drawing Figures

MANUAL STARTING DEVICE FOR WINDING YARN ONTO A BOBBIN

This invention relates to manual starting devices for winding a yarn onto a bobbin while at the same time forming a yarn reserve in a textile machine equipped with a yarn-winding system provided with a horizontal delivery roller, a press roller applied against said delivery roller, a yarn-winding roller and a yarn guide driven in reciprocating motion along a portion of the delivery roller. Two parallel winding arms are capable of pivotal motion about an axis which is parallel to the axis of the delivery roller and of elastically clamping a yarn-winding tube between the ends of said arms, said winding tube being capable of rotating while resting on the winding roller for the formation of a bobbin.

When the bobbin is formed, the yarn is arranged on the bobbin in crossed spirals laid over each other. It will readily be understood that said yarn has a "beginning" and an "end" but if special precautions are not taken, the beginning of the yarn is covered by the following spirals at the moment of building or formation of the bobbin.

In consequence, when the bobbin which has thus been completed is finally utilized, the beginning of the yarn will be found only after the yarn has been completely unwound from the bobbin.

In certain applications, it is an advantage to be able to find and handle the beginning of the yarn even before the yarn has been unwound from the bobbin. This is the case, for example, if it is found necessary to attach the beginning of one bobbin to the end of another in order to eliminate any interruption of continuity at the moment of changeover from one bobbin to another.

The device according to the invention makes it possible to place the "beginning" of the yarn on the winding tube on one side of the formed bobbin, that is to say outside the superposed layers of yarn in such a manner as to ensure that the beginning of the yarn forms an accessible "reserve".

Moreover, the majority of known winding systems call for the use of winding tubes provided with slits or studs for imparting initial motion to the yarn.

The invention also makes it possible to produce a manual yarn-starting device which is not attended by the disadvantage mentioned in the foregoing.

To this end, the device in accordance with the invention comprises a suction nozzle for aspirating the cut end of the yarn to be started, said nozzle being placed upstream of the winding roller at a lower level than the winding roller and in a lateral vertical geometrical plane which is perpendicular to the axis of said winding roller and located very close to one end of said roller. A stationary hook is placed above the level of the winding roller immediately to the rear of the winding tube carried by the winding arms when in a lowered position and also in the lateral vertical geometrical plane aforementioned. Said hook provides at least one loop for temporarily receiving that portion of the yarn which is located between the delivery roller and the suction nozzle.

In one form of construction, the hook can have two yarn-receiving loops, both loops being located substantially in the vertical plane aforementioned but at two different heights. The upper loop receives that portion of yarn which comes from the delivery roller and which will be designated hereinafter as the "main yarn" whilst the lower loop receives that portion of yarn which proceeds to the suction nozzle and which will be designated hereinafter as the "reserve yarn".

By means of the device in accordance with the invention, starting of a yarn-winding operation can thus be effected both conveniently and rapidly while at the same time forming a yarn reserve on tubes which do not have any studs, lugs or slits as was usually the case in the past. The device therefore permits the use of simple paper-board winding tubes having a sufficient degree of surface roughness to impart motion to the loop of yarn which constitutes the first turn of the bobbin to be built.

In a preferred embodiment of the invention, said device ensures reliable starting operations even if the surface of the winding tube has only a low degree of surface roughness or if the roughness is different from one tube to another. Higher operational safety and reliability are thus achieved irrespective of the quality of the winding tubes employed.

This preferred embodiment essentially consists in providing slackening means for temporarily suppressing the tension on the portion of yarn which is intended to form the yarn reserve, namely that portion which is located between the suction nozzle and the loop of the hook. Said slackening means are put into action in a transient manner at the moment when the yarn reserve begins to form on the tube.

The slackening means aforesaid can be constituted simply by means for closing-off the suction nozzle such as a shutter or, even more simply, by the operator's finger which temporarily stops the nozzle orifice.

A more complete understanding of the invention will be gained from the following detailed description and from a study of the accompanying drawings in which one embodiment of a device according to the invention is shown by way of example, and in which.

Figure 1:
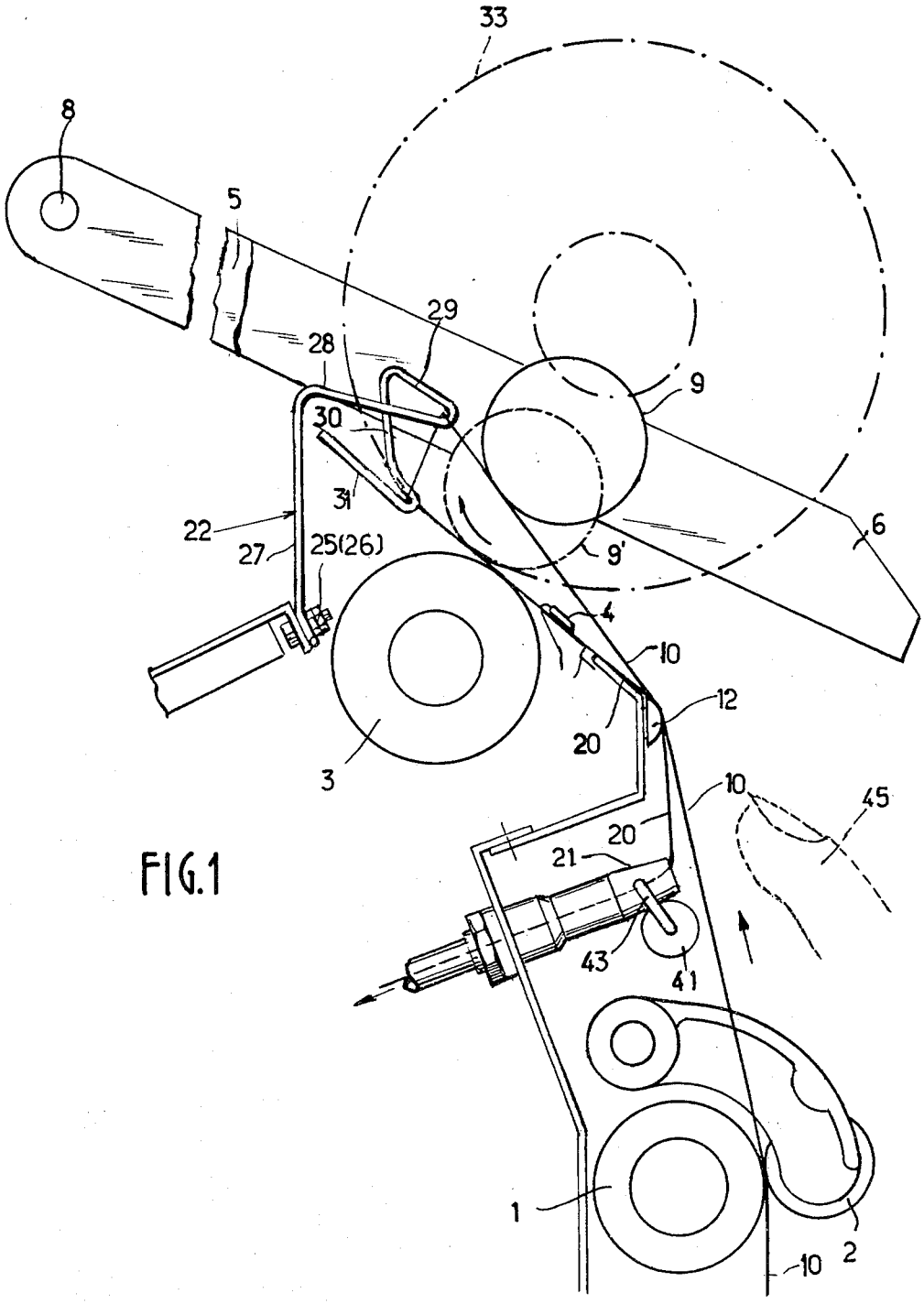
FIG. 1 is a profile view of a yarn-winding system equipped with a manual starting device according to the invention.
Figure 2:
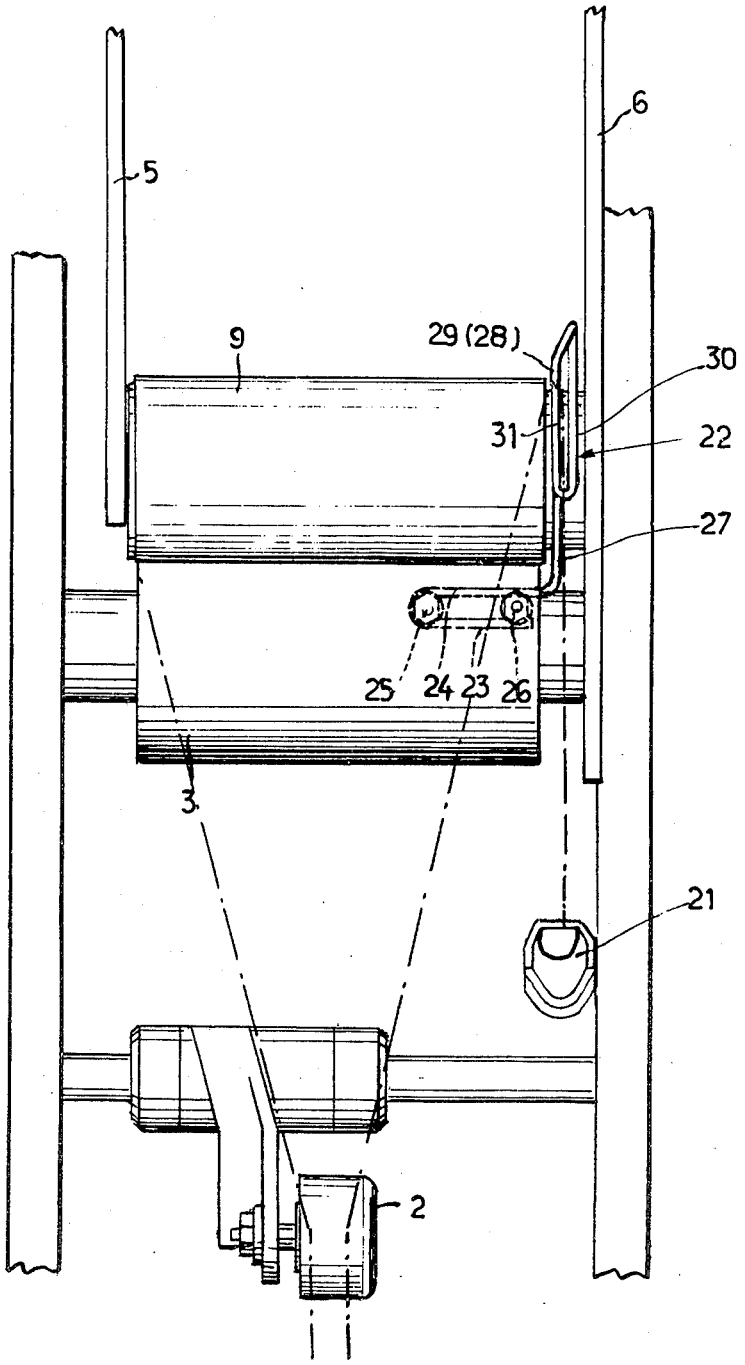
FIG. 2 is a corresponding front view.
Figure 3:
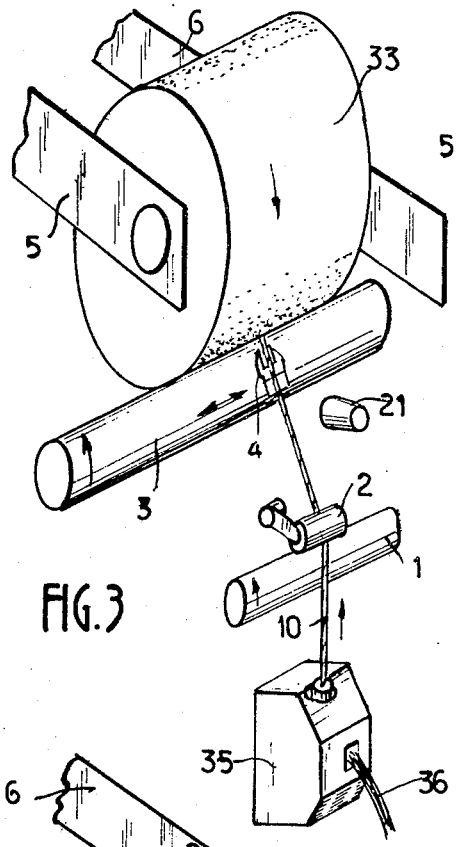
FIGS. 3 to 6 are perspective views illustrating the different stages of doffing of a full bobbin and of starting of the following bobbin.

The main part of the yarn-winding system illustrated in FIGS. 1 and 2 is of conventional type and provided with a horizontal delivery roller 1, a press roller 2 which is applied against said delivery roller, a yarn-winding roller 3, a yarn guide 4 driven in reciprocating motion along a portion of the yarn-winding roller, and two parllel winding arms 5, 6 (as also shown in FIG. 3). Said winding arms are capable of pivotal motion about an axis 8 which is parallel to the axis of the delivery roller 1 and are also capable of elastically clamping a winding tube 9 between the ends of said arms. Said winding tube has a conventional rough surface and is capable of rotating while resting on the winding roller 3 for the formation or building of a bobbin. There is also shown a fixed bar 12 for guiding the yarn 10 during the winding operation between the exit of the delivery roller 1 and the yarn guide 4.

In accordance with the invention, two stationary elements are added to this yarn-winding system, namely a suction nozzle 21 and a hook having a special configuration and generally designated by the reference 22.

The suction nozzle 21 is attached to the frame of the machine upstream of the winding roller 3 at a lower level than the winding roller and in a lateral vertical geometrical plane which is perpendicular to the axis of the winding roller and located very close to one end of said roller, namely the right-hand end when looking on the front of the device as shown in FIG. 2, and preferably externally of said roller. Said suction nozzle is connected to any suitable vacuum source.

The hook 22 is also attached to the frame of the machine and is formed by a continuous rod comprising a certain number of successive portions obtained by bending, namely a fixing portion constituted, for example, by a bottom horizontal leg 23, a top horizontal leg 24 which is parallel to the first and between which can be passed bolts 25, 26 for attaching said hook to the frame of the machine, and a portion for guiding the yarn. This yarn-guiding portion can consist of a vertical leg 27, a leg 28 which extends in the forward direction and is given a slight downward slope, a leg 29 which extends upwards towards the rear, a leg 30 which extends downwards in a practically vertical plane, and finally a leg 31 which extends upwards towards the rear. Thus the two legs 28 and 29 form a first loop or upper loop and the bottom of the upper loop is intended to receive the main yarn 10 which will be taken by the yarn guide 4 in order to build the crosswound bobbin 33 after the winding tube 9 has been lowered to position 9′ (as represented in FIG. 1 by a chain-dotted line) against the winding roller 3.

The two legs 30 and 31 form a lower loop or second loop and the bottom of the lower loop receives the portion of yarn 20 which is intended to form the yarn reserve.

Figure 4:
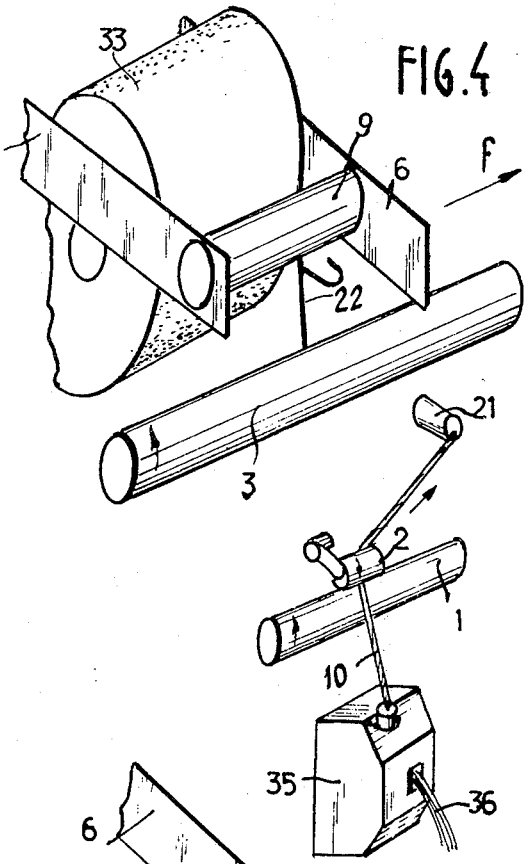
Figure 5:
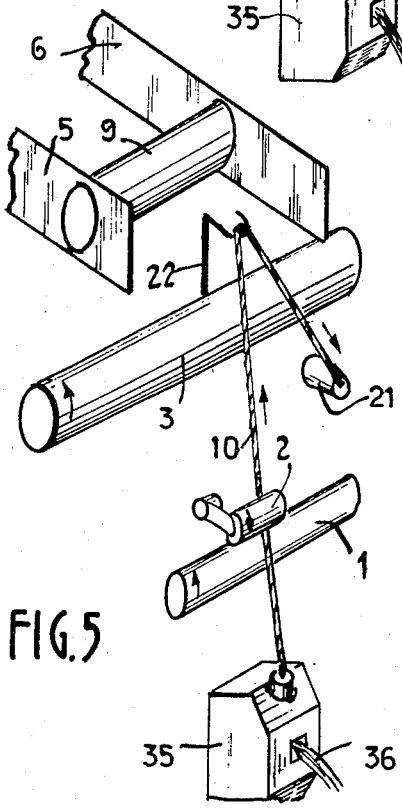
Figure 6:
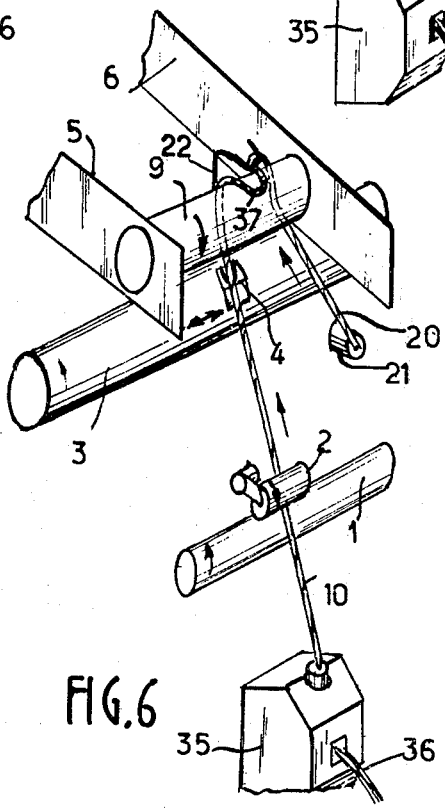

In a more simple embodiment of the invention, it is possible to employ a hook having only one loop (as shown in FIGS. 4, 5 and 6) such as, for example, a loop located at the level of the upper loop hereinabove described or alternatively at an intermediate level between the two loops of the embodiment shown in FIG. 1.

The operation of the machine as a whole can be understood by making further and successive reference to FIGS. 3 to 6 in which the different machine components are illustrated in a more schematic form. There is also shown in the lower portions of these figures a freed-fiber spinning unit in which a strand of fibers or roving 36 is admitted and then delivered in the form of a yarn 10.

During the winding operation, the yarn 10 delivered by the spinning unit 35 (or by a yarn bobbin) is taken-up by the delivery roller 1 against which the press roller 2 is applied, whereupon the yarn passes against the guide bar 12 into the yarn guide 4, then passes over the winding roller 3 against which the winding tube 9 is applied. The crosswound bobbin 33 of yarn is built on said winding tube as a result of the reciprocating motion of the yarn guide 4 as shown in FIG. 3.

When the bobbin 33 is full, the yarn 10 is cut by hand between the delivery roller and the yarn guide 4. While the spinning unit 35 continues to deliver yarn, that end of the yarn which is connected to the spinning unit is then presented to the suction nozzle 21 as shown in FIG. 4. The suction nozzle therefore absorbs the yarn as it is being delivered. The winding arm 6 is displaced towards the right or in other words in the direction of the arrow f in FIG. 4 in order to move said arm away from the winding arm 5 and thus to release the full bobbin 33 which is removed and replaced by an empty winding tube 9 whilst the winding arms 5, 6 are in their top positions; in other words, the tube 9 is not resting on the winding roller 3 and is therefore not driven in rotation. In the meantime, the nozzle 21 continues to aspirate the yarn delivered by the spinning unit and this yarn will constitute the next reserve. To this end, the operator places the yarn in the hook 22 with one finger in the manner which is clearly shown in FIG. 1 and illustrated schematically in FIG. 5. It is apparent that the portion of yarn 10 delivered by the spinning unit and the portion of yarn 20 delivered by the suction nozzle 21 have the combined effect of forming a vertical loop which is located immediately behind the winding tube when the winding tube is in its lowered position 9′ (shown in FIG. 1). By returning the winding arms 5–6 in the downward direction, the winding tube again comes into contact with the winding roller 3 and is again driven by the winding roller. By reason of the roughness of surface of the winding tube 9, the winding tube is accompanied by the loop of yarn 37 in its movement of rotation (FIG. 6), with the result that the main yarn delivered by the spinning unit as well as the reserve yarn which leaves the suction nozzle are both wound onto the winding tube 9. As it passes for the first time, the yarn guide grips the yarn 10 and a fresh bobbin begins to form in crossed spirals. At the same time, the yarn 20 delivered by the suction nozzle is guided by the lower loop of the hook 22 in order to form a yarn reserve on the right-hand end of the winding tube, that is to say externally of the crosswound bobbin 33 which is being built. The reserve is therefore not liable to become tangled with the turns of main yarn 10, the end positions of which correspond to the ends of travel of the yarn guide 4. When the number of turns of reserve yarn is considered sufficient, said yarn 20 is cut-off, with the result that the remainder is aspirated by the nozzle 21 and discharged to waste. The starting operation for winding the yarn and forming the reserve is carried out entirely by hand without the aid of any tool.

As shown in FIG. 1, the upper loop of the hook 22 is located above the axis of the winding tube when the winding tube is in its lowered position and rests on the winding roller, said loop being preferably located substantially in a horizontal plane which is tangent to the top portion of the winding tube in its lowered position. Said loop can be located, for example, at approximately 2 mm to the rear of the winding tube when the winding tube is in its lowered position aforesaid. By virtue of this location of the loop of the hook 22, the main yarn 10 is thus maintained in contact with an appreciable portion of the periphery of the winding tube, with the result that winding of the yarn is started by friction on the tube surface without any need to provide the tube with studs, lugs or slits as in other known system.

The lower loop of the hook 22 may be located substantially in the common plane which is tangent to the winding roller 3 and to the winding tube in its lowered position. It is in fact apparent from a comparison of FIGS. 5 and 6 that the direction of travel of that portion of the reserve yarn which is located between the hook 22 and the suction nozzle 21 is reversed at the moment of starting of winding of the yarn onto the winding tube (the reserve yarn which was initially absorbed by the nozzle is then discharged from the nozzle in order to form the reserve). In other words, just as the winding tube begins to be driven in rotation, the yarn 20 is still travelling in the direction opposite to the direction of displacement of the periphery of the winding tube. The lowest position of the second loop therefore permits a lower degree of friction of the reserve yarn on the winding tube at the moment of starting, with the result that this starting operation usually takes place more rapidly with a hook having two loops than with a hook having only one loop. Furthermore, the low position of the lower loop ensures better separation of the yarns 10 and 20 and guarantees that the reserve yarn 20 will escape from the yarn guide 4.

It is apparent from FIG. 1 that the suction nozzle 21 can be closed-off by means of a pivoting shutter or obturator 41 such as a rubber ball supported by a stirrup-piece 43 or alternatively by the operator's finger 45 for transient closure of the nozzle.

Figure 7:
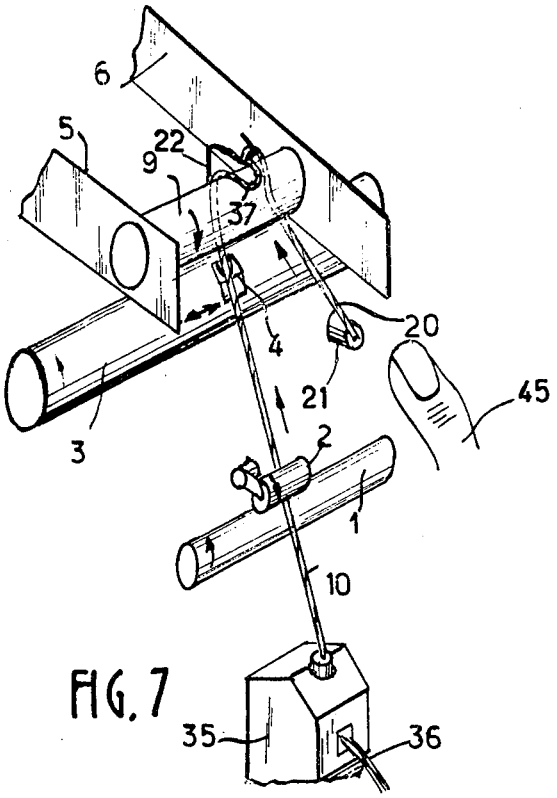
FIG. 7 is a view illustrating the mode of operation in the state shown in FIG. 6.

During the starting stage shown in FIG. 7, the yarn reserve begins to form on the tube 9 as described in the foregoing in connection with FIG. 6. The mode of operation illustrated in FIG. 7 is intended to facilitate starting of the reserve even if the winding tube has a low degree of surface roughness.

Said yarn reserve is started and adheres to the tube from the moment of formation of the loop 37 and is taken-up by the more or less rough surface of the empty tube 9.

In order to assist formation of the loop 37, the yarn 20 is slackened for a brief moment. To this end, the operator need only stop the suction nozzle 21 temporarily either with his finger 45 or by displacing the obturator 41 in pivotal motion to the closed position.

By closing-off the suction 21, the yarn 20 is no longer aspirated by the nozzle and is slackened so as to form the loop 37. The movement of rotation of the empty tube 9 then has the effect of taking-up the yarn loop 37 which is wound onto the tube so as to start the winding operation. At this moment, the suction is unstopped and the yarn 20 delivered by the nozzle 21 then forms the yarn reserve whilst the yarn 10 which is taken into the guide 4 constitutes the crosswound bobbin.

By virtue of this temporary suppression of tension on the yarn 20, the starting operation takes place in a reliable manner.

As can readily be understood, the invention is not limited in any sense to the embodiment hereinabove described with reference to the accompanying drawings and, depending on the applications which are contemplated, can accordingly extend to many alternative forms of construction within the capacity of anyone versed in the art without thereby departing either from the scope or the spirit of the invention.

What is claimed is:

1. A manual starting device for winding a yarn onto a bobbin while at the same time forming a yarn reserve in a textile machine equipped with a yarn-winding system provided with a horizontal delivery roller, a press roller applied against said delivery roller, a yarn-winding roller disposed above said delivery roller, a yarn guide driven in reciprocating motion along a portion of the winding roller, two parallel winding arms mounted for pivotal motion between a lower position and an upper position about an axis parallel to the axis of the delivery roller and of elastically clamping a yarn-winding tube between the ends of said arms, said winding tube being provided with a rough surface and capable of rotating while resting on the winding roller for the formation of a bobbin, wherein said manual starting device comprises a suction nozzle for aspirating the end of the yarn which has been cut at the beginning of a bobbin-changing operation, said nozzle being placed upstream of the winding roller at a lower level than the winding roller and in a lateral vertical geometrical plane which is perpendicular to the axis of said winding roller and located very close to one end of said winding roller externally thereof, and a supported stationary hook located directly above the level of the winding roller immediately behind the winding tube carried by the winding arms in said lower position and also in the lateral vertical geometrical plane aforesaid, said hook being adapted to provide at least one loop for temporarily receiving that portion of the yarn which is located between the delivery roller and the suction nozzle, said at least one loop being located in the immediate vicinity and to the rear of the winding tube when said tube rests on the winding roller and above the axis of said tube when said winding arms are in said lower position.

2. A device as claimed in claim 1, wherein said hook has two loops located one above the other, the upper loop being intended to receive the main yarn derived from the delivery roller and the lower loop being intended to receive the reserve yarn which proceeds to the suction nozzle.

3. A device as claimed in claim claim 2, wherein the upper loop of the hook is located substantially in a horizontal plane tangent to the upper portion of the winding tube which rests on the winding roller.

4. A device as claimed in claim 2, wherein the lower loop is located substantially in the tangent plane which is common to the winding roller and to the winding tube which rests on the said winding roller.

5. A device as claimed in claim 1, wherein said device comprises yarn-slackening means adapted to temporarily suppress the tension exerted by the suction nozzle on that portion of the yarn which is intended to form the yarn reserve, said yarn-slackening means being put into action in a transient manner at the moment of commencement of formation of the yarn reserve on the winding tube.

6. A device as claimed in claim 5, wherein the yarn-slackening means aforesaid comprises a member for closing-off the orifice of the suction nozzle.

7. A device as defined in claim 6, wherein the closing-off member is constituted by a movable obturator mounted on the nozzle.

8. A device as claimed in claim 6, wherein the closing-off member is constituted by the operator's finger.

9. A method for manually starting a yarn winding onto a bobbin while at the same time forming a yarn reserve in a textile machine equipped with a yarn-winding system which comprises a horizontal delivery roller, a press roller applied against said delivery roller, a yarn-winding roller disposed above said delivery roller, a yarn guide driven in reciprocating motion along a portion of the winding roller, two parallel winding arms being capable of pivotal motion about an axis parallel to the axis of the delivery roller and of elastically clamping a yarn winding tube between the ends of said arms, a suction nozzle placed upstream of the winding roller at a lower level than the winding roller and in a lateral vertical geometrical plane perpendicular to the axis of the winding roller and located very close to one end of said winding roller externally thereof, and a supported stationary hook located directly above the level of the winding roller immediately behind the winding tube, said method comprising cutting the yarn between the delivery roller and the yarn guide, aspirating the cut end of the yarn coming from the delivery roller with the suction nozzle, pivoting said arms to an upper position, loading an empty winding tube on said arms, lowering said arms to a lower position to thereby bring said winding tube in contact with said winding roller, forming a loop of yarn between the delivery roller and said hook, causing the last mentioned loop to adhere to said winding tube, and stopping the suction nozzle orifice temporarily by hand as soon as the loop begins to form on the winding tube.

10. A device as claimed in claim 1, wherein said hook has a single loop.

11. A device as claimed in claim 10, wherein the single loop is located substantially in a horizontal plane tangent to the upper portion of the winding tube which rests on the winding roller.

* * * * *